US005706611A

United States Patent [19]

Attaway et al.

[11] Patent Number: 5,706,611

[45] Date of Patent: Jan. 13, 1998

[54] FASCIA

[75] Inventors: Julian J. Attaway, Marietta; Larry M. Petree, Lawrenceville, both of Ga.

[73] Assignee: MM Systems Corporation, Tucker, Ga.

[21] Appl. No.: 700,962

[22] Filed: Aug. 21, 1996

[51] Int. Cl.[6] ..... E04D 1/36

[52] U.S. Cl. ..... 52/60; 52/94; 52/97

[58] Field of Search ..... 52/60, 94, 96

[56] References Cited

U.S. PATENT DOCUMENTS 3,533,201 10/1970 Tyler ..... 52/60

4,404,777 9/1983 Lolley et al. ..... 52/60

*Primary Examiner*—Carl D. Friedman

*Assistant Examiner*—Creighton Smith

*Attorney, Agent, or Firm*—Needle & Rosenberg, P.C.

[57] ABSTRACT

A fascia for use at the juncture of a building wall and a roof deck comprising a fascia member, a cant member, a flashing member, at least one clip, and a screw disposed through the clip for adjusting the position of each clip relative to the flashing member. Adjustably positioning the clip away from the flashing member positions the top portion of the flashing member toward the top horizonal segment of the fascia member and presses the bottom portion of the flashing member against the roofing material disposed on the second panel of the cant member. This provides structural strength to the fascia and improves the weather resistant characteristics of the fascia.

8 Claims, 6 Drawing Sheets

FASCIA

BACKGROUND OF THE INVENTION

1. Field of the Invention

The present invention relates generally to a building roofing structure and, more particularly, to an improved fascia for providing a roof edge treatment and a water dam for the juncture of a building wall and a roof deck.

2. Background Art

A fascia is the preferred treatment for buildings having a roof deck which has a low pitch or a substantially horizonal top surface. An advantage of a fascia is that it is aesthetically pleasing. It is also functional because it retains roof water and prevents the water from spilling over the end of the deck. A fascia also retains other materials disposed on the roof deck, such as gravel. Thus, a fascia is a desired feature on a building for architectural, engineering, and construction reasons.

One example of a prior art fascia is disclosed in U.S. Reissue Pat. No. 27,761, reissued Sep. 18, 1973, which is hereby incorporated by reference. This patent discloses a conjoint fascia and water dam that had a longitudinally-extending fascia member 1, flashing member 2, and cant member 3, as shown in FIG. 1 of the present drawings. The fascia member 1 has a vertical body segment 4 and an attached, inwardly-directed, relatively horizonal top segment 5. This top segment 5 has a lip 6 depending therefrom. The lip 6 is directed downwardly adjacent the top segment 5 and then outwardly towards the vertical segment 4 of the fascia member 1. A plurality of longitudinally separated holes (not shown) are punched into the top segment 5 of the fascia member 1 and are located further laterally inward than the lip 6. The holes have screws 7 disposed therethrough.

The top portion 8 of the flashing member 2 has a surface that is complementarily received in the lip 6. The bottom end 7A of the screw 7 engages an intermediate portion of the flashing member so that the lower portion 9 of the flashing member 2 presses against the roof material R.

The cant member 3 is disposed on the top surface of the roof deck and has an inclined surface on which the roofing material R is disposed. Thus, roofing material R is disposed on the cant member 3 at an angle relative to the horizonal plane and the lower portion 9 of the flashing member 2 is added in an overlapping relationship. The flashing member 2 seals against water penetration and the resulting barrier prevents water from spilling over the fascia and also retains materials disposed on the roof.

However, this prior art fascia has disadvantages. For example, holes are required to be punched in the horizonal segment 5 of the fascia member 1. Although holes can be inserted during the manufacturing process, it is difficult to add or drill additional holes at the installation site if more are needed, e.g., to increase the structural strength of the fascia. Thus, there exists a need in the art to increase the strength of the fascia at the installation site without requiring the drilling of additional holes into the fascia member. It is even more desired to avoid forming holes in the fascia at all and, instead, use a different means to anchor the fascia member to the flashing member that provides at least equal strength and weather resistant characteristics.

It is also desired to have a fascia product having the positive attributes shown in the prior art, but being more economical. An example is using prefinished materials, which could not effectively be used with the prior art.

It is further desired to have a fascia that can be non-linear. An example is a fascia disposed on a round building roof.

While the prior art fascia may be curved, such curving of the fascia member requires that the horizonal segment be notched to ease the stresses. These notches must then be welded together, which is both time consuming and labor intensive. Thus, there is a need to have a fascia member that can be curved and not require notching and welding.

There is a similar need to have an easy method to make angled corners. The fascia in the prior art must be mitered to the desired angle and welded on the face and top. Similar to curving the prior art fascia member, this process is time consuming and exacting. Therefore, a need exists to form comers in the fascia member without necessarily using a cutting and welding technique.

SUMMARY OF THE INVENTION

The above disadvantages of the prior art are overcome by the present invention which provides an improved fascia having a fascia member, a flashing member, and a cant member. The present invention also includes a clip and a means for adjusting the clip relative to the flashing member, instead of having holes disposed through the fascia member. The clip interlocks the top and middle portion of the flashing member. This improved fascia provides all of the benefits of the fascia in the prior art; however, the present invention has many additional advantages over the prior art fascia.

The clips preferably are removable from the fascia so that they can be disposed at any desired longitudinal separation distance. Thus, holes are not punched into the fascia member and the fascia is easier to install. Also, it is easy to add more clips at the installation site, if needed.

The improved fascia of the present invention also allows the bending of the fascia member to a desired radius without requiting notching or welding. This is possible because the lip on the fascia member is no longer used and the resulting stresses are negligible compared to the prior art fascia.

Also, forming corners in the fascia member of the present invention is much easier. Although mitering is an option, other more efficient methods are available. One example is to remove a portion of the sheet metal before it is made into a fascia wall where it is to be folded. Thus, no welding is necessary and, in fact, a fastener maintaining the folded portion is optional. The linearly formed fascia member can likewise be easily notched and then the member bent. In contrast, the prior art fascia had to be mitered and the entire mitered face had to be welded.

The present invention is more economical than the prior art fascia, while still maintaining the positive attributes of the prior art fascia. Another advantage is that the present invention can use a fascia of any dimension by manufacturing with a desired size or gauge of material. Likewise, prefinished materials can be used.

BRIEF DESCRIPTION OF THE FIGURES OF DRAWINGS

DETAILED DESCRIPTION OF THE INVENTION

Figure 1:
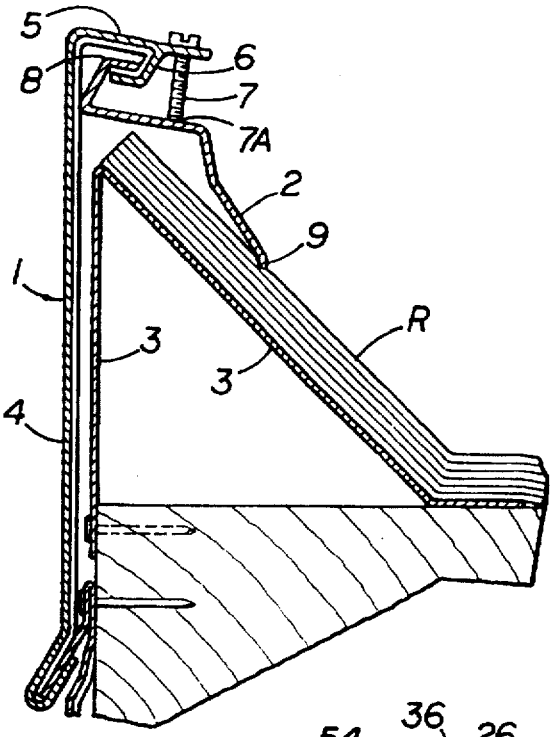
PRIOR ART FIG 1
FIG. 1 is a vertical cross-sectional view of a prior art fascia.

The present invention is more particularly described in the following examples which are intended as illustrative only since numerous modifications and variations therein will be apparent to those skilled in the art. As used in the specification and in the claims, "a" can mean one or more, depending upon the context in which it is used.

Referring generally to FIGS. 2–8, the present invention comprises an improved fascia 10 for use at the juncture of a building wall W and a roof deck D in which the roof deck D has a top surface T for disposing a roofing material R thereon and an edge E. The fascia 10 comprises a fascia member 20, a cant member 40, a flashing member 50, at least one clip 70, and a means 80 disposed on the clip 70 for adjusting the position of each clip 70 relative to the flashing member 50. While only a portion of the fascia 10 is depicted, it will be understood that the fascia 10 borders, and longitudinally co-extends, with the edge E and building wall W.

Figure 2:
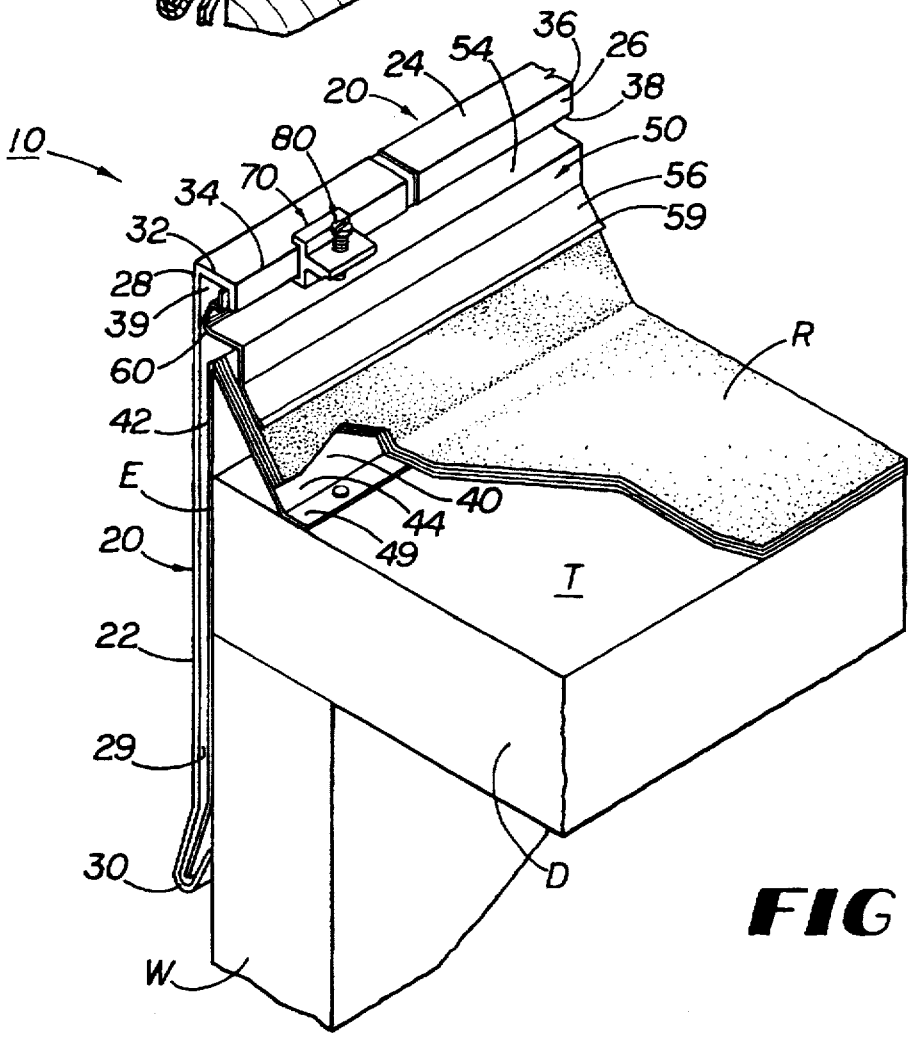
FIG. 2 is a perspective view of the improved fascia of the present invention, with certain portions thereof broken away for clarity.
Figure 3:
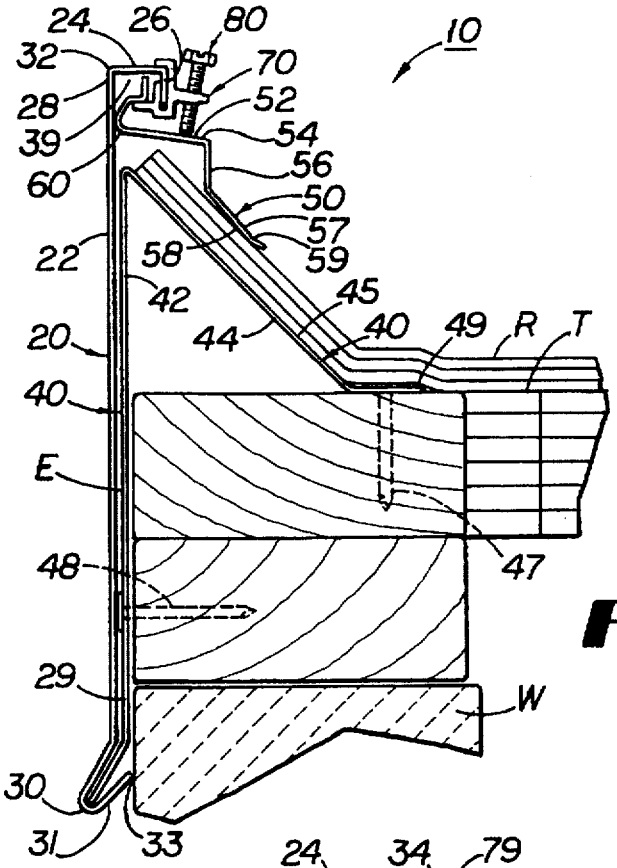
FIGS. 3 and 4 are side views of the fascia of the present invention.
Figure 4:
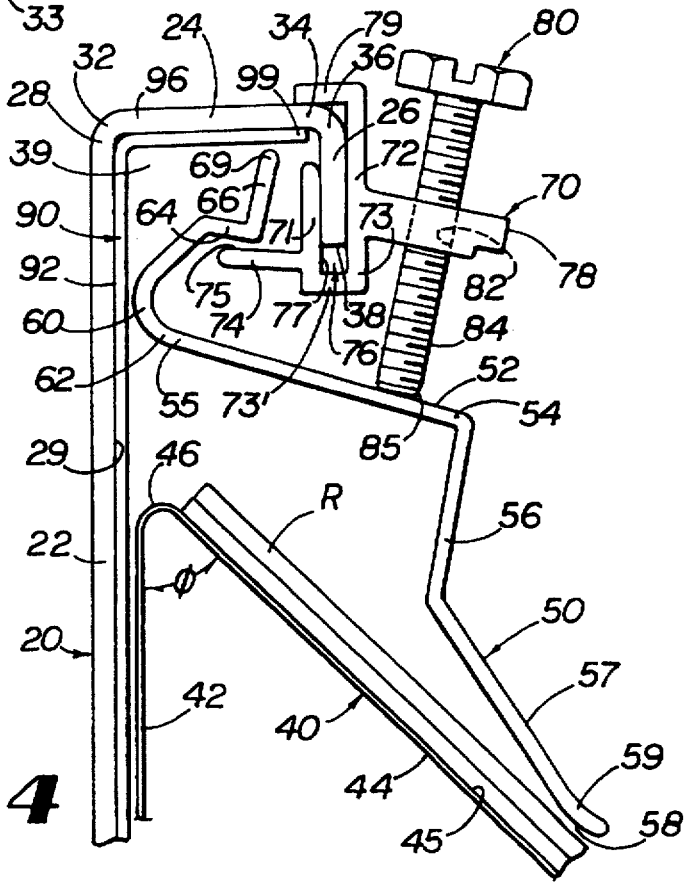

The fascia member 20 is preferably formed or extruded from aluminum alloy or steel sheets, and it is particularly advantageous to use prepainted sheets. However, other suitable materials may be used. Referring now to FIGS. 2–4, the fascia member 20 has an elongated, upright fascia wall 22 that terminates at its upper end 28 in a horizonally-disposed head component 24, which projects inwardly and over the roof deck D. The fascia wall 22 has a lower end 30, which is opposite from the upper end 28, and an interior surface 29 directed toward the edge E of the roof deck D. The lower end 30 curves upwardly to form lower section 31 which terminates in end 33 that abuts the exterior surface of wall W. As shown in FIGS. 2 and 3, the edge E of the roof deck D and the wall W are substantially aligned with each other, and the interior surface 29 of the fascia member 20 is substantially flush with and parallel to the edge E and wall W. The head component 24 has a first end 32 attached to the upper end 28 of the fascia wall 22 and an opposite second end 34.

Figure 5:
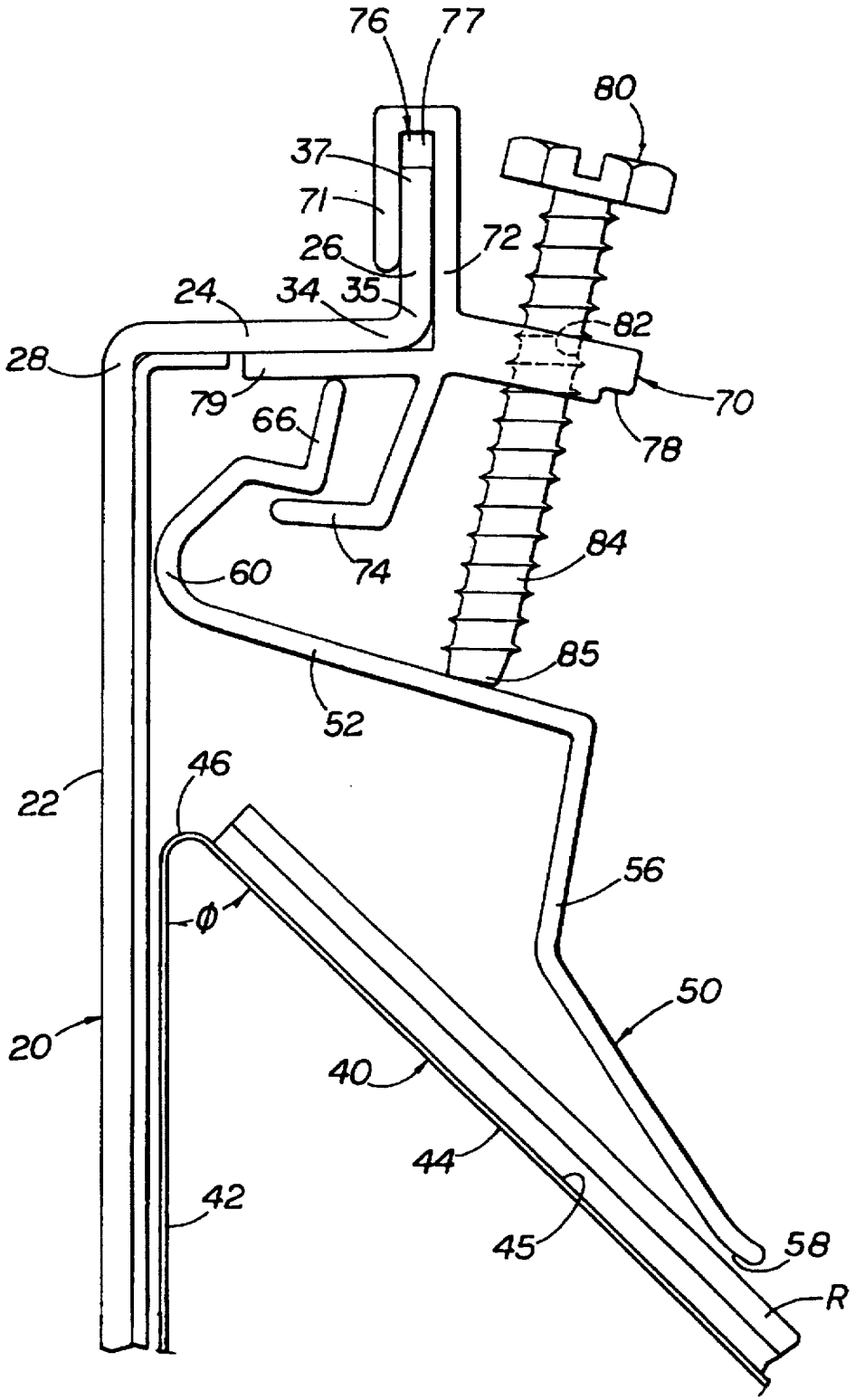
FIG. 5 is a side view of the second embodiment of the fascia of the present invention.

The fascia member 20 can further comprise a downwardly directed finger 26 portion having a top end 36 depending from the second end 34 of the head component 24 and an opposite bottom end 38. The finger 26 can be used in conjunction with the clip 70 and adjusting means 80, as discussed below. In the preferred embodiment, as shown in FIGS. 2–4, the upper end 28 of the fascia wall 22, the head component 24, and the finger 26 define a recess 39 therebetween. Alternatively, as shown in FIG. 5, the finger 26 can extend upwardly from the second end 34 of the head component 24. The finger 26 comprises a lower end 35 formed at the second end 34 of the head component 24 and an opposite top end 37.

The cant member 40 has an upright first panel 42 and a downwardly directed second panel 44, which are joined together at their respective upper ends by curved portion 46. As seen in FIGS. 4 and 5, an acute angle $\phi$ is formed between the first and second panels 42, 44. The first panel 42 is disposed so that at least a portion of it is disposed between the interior surface 29 of the fascia wall 22 and the edge E of the roof deck D. Referring to FIG. 3, the second panel 44 has an outer face 45 and terminates in a horizontally extending lower end portion 49 that is detachably secured to the top surface T of the roof deck D for receiving a portion of the roofing material R thereon. It is preferred that the first panel 42 be substantially parallel to the fascia wall 22. The second panel 44, accordingly, is placed at an incline upon which the roofing material R is placed so as to direct rain water away from the fascia 10 and towards the drainage system of the building roof.

The preferred material for the cant member 40 is galvanized steel. The lower end 49 of the second panel 44 is preferably detachably secured to the top surface of the roof deck D by galvanized roofing nails 47, as shown in FIGS. 2 and 3. A portion of the first panel 42 adjacent the edge E of the roof deck D is also detachably secured to the edge E using galvanized roofing nails 48, as shown in FIG. 3.

As seen most clearly in FIG. 4, the flashing member 50 comprises a first segment 52, second segment 56, third segment 57, arcuate segment 60, and an upwardly-extending leg 66. The first segment 52 has a downwardly directed slope, extending from its upper end 55 to its opposite second, lower end 54, to which the second segment 56 depends towards the cant member 40. The second segment 56 terminates at its lower end in outwardly directed third segment 57, which has a bottom end 59 that extends parallel to and engages on its bottom surface 58 a portion of the roofing material R disposed on the outer face 45 of the second panel 44 of the cant member 40. The arcuate segment 60 has a lower end 62 connected to the upper end 55 of the first segment 52 and terminates at its top end in inwardly directed section 64. At least a portion of the arcuate segment 60 is adjacent the interior surface 29 of the fascia wall 22. In other embodiments, the arcuate segment 60 does not necessarily have a continuous curvature but may, instead, have a squared "C" shape in cross-section.

Section 64 terminates in upwardly-extending leg 66 which has a free end 69 disposed adjacent to and beneath the head component 24 of the fascia member 20. It is also contemplated that the leg 66 can extend upwardly at an acute angle (i.e., at a thirty (30) degree angle) with the horizonal plane. The leg 66 can also extend downwardly so that section is disposed adjacent the head component 24.

Again as seen in FIG. 4, each clip 70 has an elongated body portion 72, a means 76 on the body portion 72 for engaging the fascia member 20, and a first protrusion 74 extending from the body portion 72 towards the interior surface 29 of the fascia wall 22. The first protrusion 74 has an upper surface 75 that engages the section 64 of the arcuate segment 60 of the flashing member 50. The upper surface 75 can, alternatively, engage the leg 66 or some other portion of the flashing member 50 so that the flashing member 50 interfaces with the clip 70.

In the preferred embodiment shown in FIGS. 3 and 4, the body portion 72 of the clip 70 has a first upright portion 71, an opposed second upright portion 73 and a horizontal section 73 which joins portions 71, 73 and which define a slot 77. The engaging means 76 of the clip 70 comprises the slot 77, which is of a size to slidably and detachably receive therein the finger 26 of the fascia member 20. In this embodiment, the clip 70 further comprises a second protrusion 78 downwardly extending from the second side 73 of the body portion 72 and being oppositely directed from the first protrusion 74.

During installation of the improved fascia 10, it desirable to stabilize the clip 70 to assist in starting and selectively adjusting a threaded screw 84 relative to an opening 82 formed in the second protrusion 78 until the bottom end 85 of the screw 84 engages the first segment 52 of the flashing member 50. As shown in FIGS. 2–4, this can be achieved by the clip 70 further comprising a horizonal member 79 extending from the second side 73 of the body portion 72. The bottom suffice of horizonal member 79 engages the head component 24 of the fascia member 20 adjacent second end 34. The horizonal member 79 facilitates disposing the screw 84 through the opening 82 in the second protrusion 78 of the clip 70.

FIG. 5 shows an alternative embodiment of the clip 70. The clip 70 has an elongated body portion 72, a means 76 on the body portion 72 for engaging the fascia member 20, and a first protrusion 74 extending from the body portion 72 towards the interior surface 29 of the fascia wall 22 for engaging the flashing member 50. The clip 70, however, engages a second embodiment fascia member 20 having an upwardly-directed finger 26. The clip 70 has a first side 71 and a second side 73 which define a slot 77 therebetween in which the finger 26 is disposed. The horizonal member 79, however, is disposed below the head component 24. The clip 70 can also comprise a second protrusion 78.

Other clip designs can be used so long as the clip can be adjusted to push the free end 69 of the upwardly-extending leg 66 toward the head component 24 of the fascia member 20 while the bottom surface 58 of the third segment 57 is pressed against the roofing material R. For example, finger 26 can be disposed at an angle relative to the vertical plane, whereas FIGS. 4 and 5 show the finger 26 vertically disposed. By way of example, the finger 26 can extend inwardly at a forty-five (45) degree angle from both the horizonal and vertical planes. Thus, the clip 70 and slot 77 would be disposed accordingly. One consideration is that the clip 70 should not be readily visible. On a tall building, this is not an issue because the clips 70 will not be discernable by pedestrians or people in neighboring, shorter building.

The adjusting means 80 adjustably positions the clip 70 away from the first segment 52 of the flashing member 50. The adjusting means 80 thus directs the free end 69 of the upwardly-extending leg 66 and/or the arcuate segment 60 of the flashing member 50 toward the head component 24 of the fascia member 20 and presses the bottom end 59 of the second segment 56 of the flashing member 50 against the roofing material R disposed on the second panel 44 of the cant member 40.

Referring to FIGS. 2–5, the adjusting means 80 comprises an opening 82 through the second protrusion 78 of the clip 70 and a screw 84 received therethrough. The screw 84 has a bottom, or shank, end 85. The screw 84 is selectively adjusted relative to the opening 82 in the second protrusion 78 so that the bottom end 85 of the screw 84 engages the first segment 52 of the flashing member 50. Once in this position, further downward movement of the screw 84 causes the bottom end 59 of the second segment 56 of the flashing member 50 to press clampingly against the roofing material R disposed on the inclined second panel 44 of the cant member 40. This improves the structural stability and the weather resistant characteristics of the fascia 10.

The opening 82 in the second protrusion 78 can be threaded, drilled, or punched. If the opening 82 is threaded, then a complementarily threaded screw 84 is used. If the opening 82 is not threaded, then a self-tapping screw 84 can be used. As one skilled in the art will appreciate, many variations are possible, including disposing the second protrusion 78 at a different location on the clip 70 and at a different angle relative to the second side 73. Likewise, the screw 84 can be disposed at different angles relative to the clip 70 and the first segment 52 of the flashing member 50, so long as the adjusting means 80 functions properly.

Figure 6:
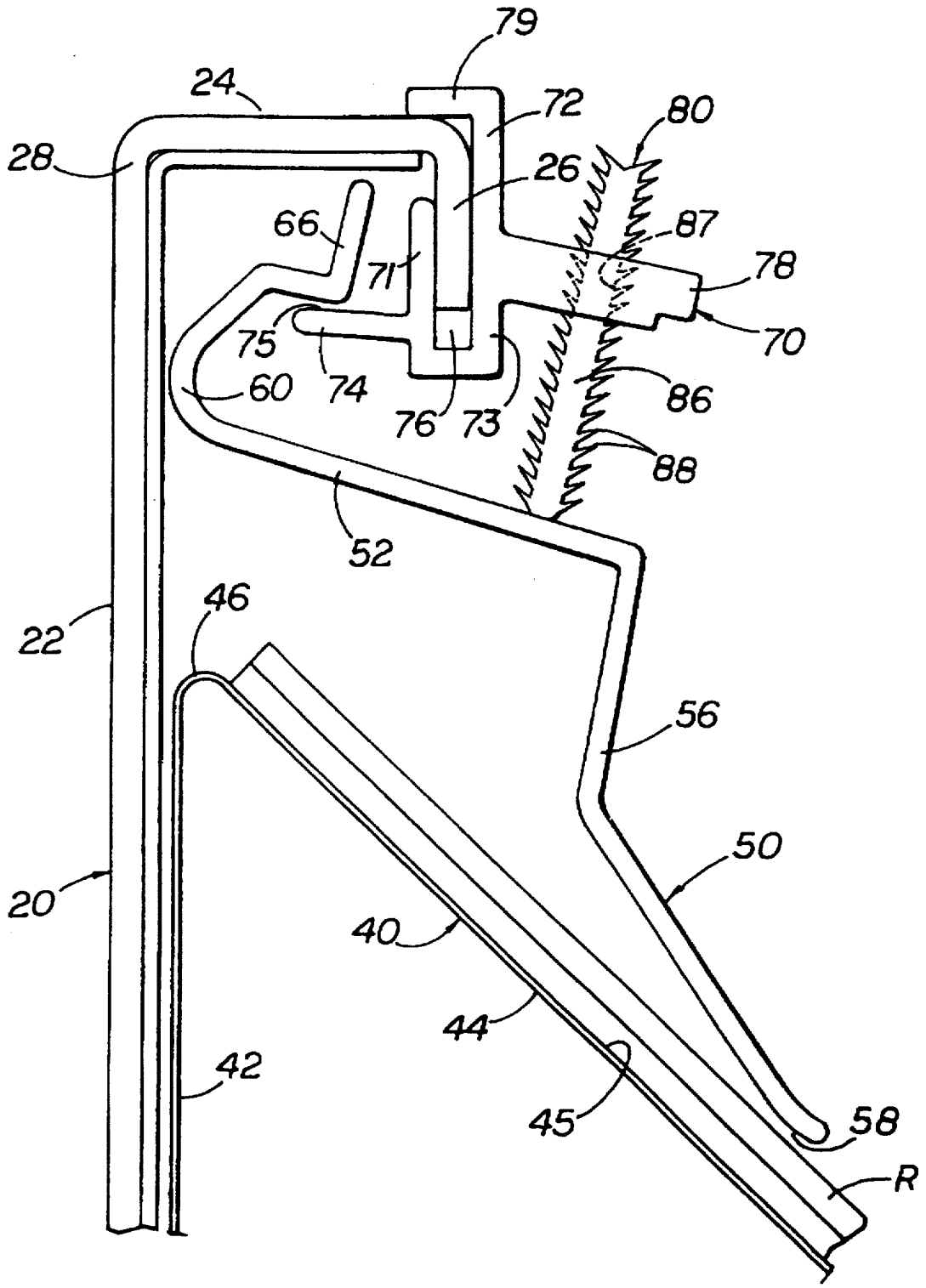
FIG. 6 is a side view of the third embodiment of the fascia of the present invention.

Other adjusting means 80 include fastener 86 having flanges 88 that allow movement in one direction and inhibit movement in the opposite direction, as shown in FIG. 6. The fastener 86 is disposed through a complementarily shaped slot 87 in the second protrusion 78 and is pushed downwardly until the leading end 89 of the fastener is against the first segment 52 of the flashing member 50 with the desired pressure. The flanges 88 on the fastener 86 maintain the position of the fastener 86 and, therefore, the pressure on the first segment 52 of the flashing member 50. An advantage of this adjusting means 80 is the ease of installation.

Other adjusting means 80 can also be used that pushes the clip 70 away from the first segment 52 of the flashing member 50. Examples include a spring means (not shown), racketing means (not shown) or similar device to push the clip 70 away from the flashing member 50.

The present invention improves the stability of the fascia 10 by providing structural strength. The fascia 10 must withstand horizontally oriented forces applied away from the fascia wall 22, such as wind forces. The lower end 30 of the fascia wall 22 and lower section 31 define therebetween a channel which receives therein the bottom of the first panel 42 of the cant member 40, as shown in FIGS. 2 and 3. At the other end of the fascia member 20, the finger 26 presses against the leg 66 of the flashing member 50 through the clip 70. The adjusting means 80 also locks the flashing member 50 into place because it is pressed against the cant member 40 and the roofing material R disposed thereon. Thus, the flashing member 50 provides a stable interface via its leg 66 to give the essential anchor to the fascia 10.

The fascia 10 usually comprises more than one clip 70. Each clip 70 is preferably longitudinally separated from each adjacent clip 70 by a predetermined distance. In the presently preferred embodiment, a separation of nineteen inches exists between the centerline of adjacent clips 70 to withstand environmental stresses. As one skilled in the art will appreciate, this distance can be changed as necessary. As will also be appreciated, the longitudinal length of the clips 70 can vary or each clip 70 can use multiple screws 84, depending on the use and the environmental stresses.

The present invention also improves the weather resistant characteristics of the fascia 10 because, referring to FIGS. 2 and 3, leg 66 is disposed in the recess 39 of the fascia member 20 and the bottom end 59 of the flashing member 50 is pressed against the roofing material R. As seen in FIGS. 4 and 5, the leg 66 of the flashing member 50 functions as a "weather stop" against blowing rain from entering the fascia 10 between the free end 69 of the leg 66 and the head component 24. Rain is also prohibited from entering the fascia 10 on the other end of the flashing member 50 because the bottom end of the second segment 56 is firmly pressed against the roofing material R. The second panel 44 of the cant member 40 is also inclined to prevent accumulation of roof water adjacent the fascia 10.

The present invention, moreover, is designed so that fasteners do not penetrate into or through the roofing material R. Accordingly, water leaks or premature deterioration is less likely to occur in the roofing material R.

It is also preferred for manufacturing and installation considerations to install a plurality of juxtaposed, longitudinally-extending fascia members 20 along the edge E of the roof deck D, as shown in FIG. 2. Each fascia member 20 abuts the adjacent fascia member 20. At this juncture, it is preferred to insert a splice member 90 below the fascia members 20, as shown in FIG. 4, which consists of a vertical segment 92, which terminates at its upper end 94 in an inwardly projecting, horizontal segment 96. The vertical segment 92 is disposed intermediate the interior surface 29 of the fascia wall 22 and the first panel 42 of the cant member 40. The inwardly projecting segment 96 is disposed adjacent the head component 24 of the fascia member 20 and has an second end 99 adjacent the second end 34 of the head component 24. This design allows the splice member 90 to be more easily bent to a desired radius. The splice plate 90 can also include an additional segment (not shown) that is parallel to the finger 26 of the fascia member 20. Unlike the present invention, however, this additional segment was needed in the prior art designs for "weathering" purposes.

The fascia 10 of the present invention has the advantage over the prior art that it can be curved very easily to a desired radius. This bending can be achieved by disposing a hard plastic filler (not shown) adjacent the interior surface 29 of the fascia wall 22 so that the top of the filler is adjacent the head component 24. The plastic assumes the shape of the desired radius in either the concave or convex direction. The plastic is then removed after bending and the fascia member 20 remains in the curved condition. In contrast, the prior art fascia must be notched and the notches welded together. This is because the prior art fascia wall includes a lip that interfaces with the flashing member. This lip prevents bending without the notches being inserted because of the stresses that would develop.

Figure 7A:
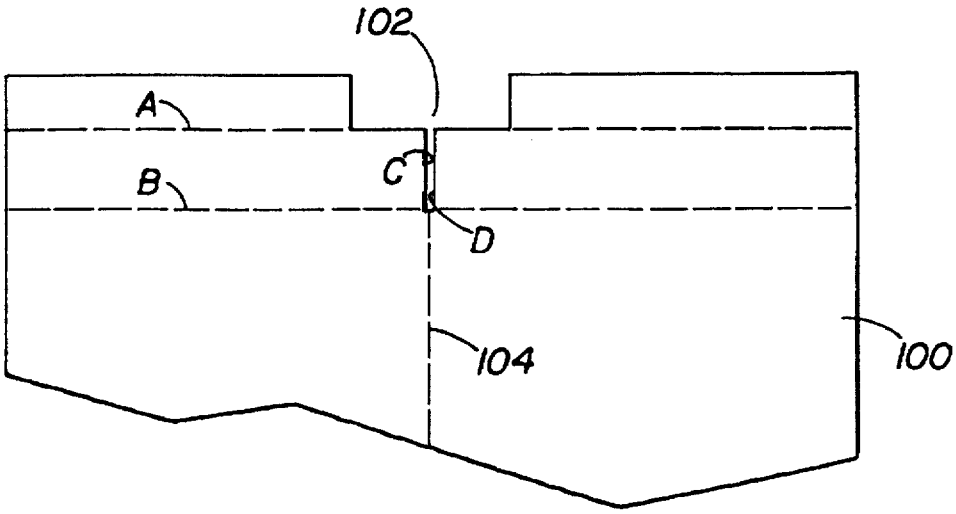
FIG. 7A is a top plan view of sheet metal that is pre-cut to form the fascia member of the present invention.
Figure 7B:
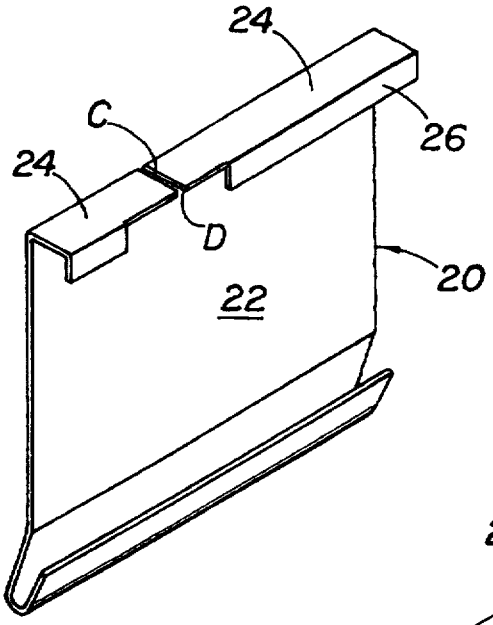
FIG. 7B is a perspective view of a fascia member formed from the sheet metal of FIG. 7A.
Figure 7C:
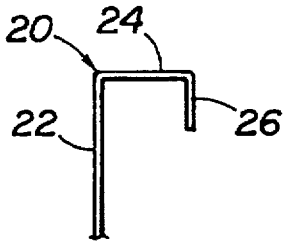
FIG. 7C is a side elevational view of the upper portion of the fascia member of FIG. 7B.
Figure 7D:
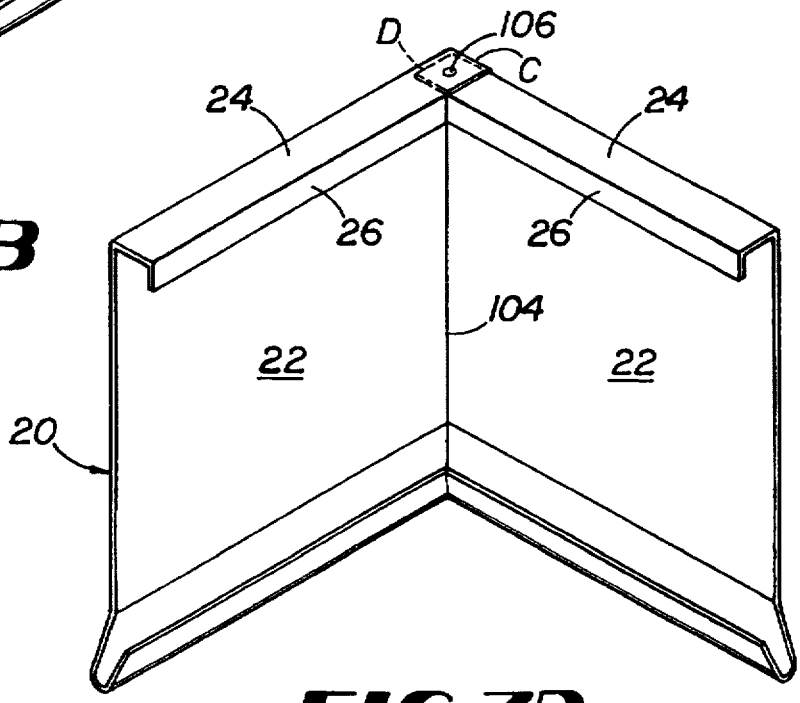
FIG. 7D is an elevated front view of the fascia member of FIG. 7B that has been folded to form a right angle.
Figure 8A:
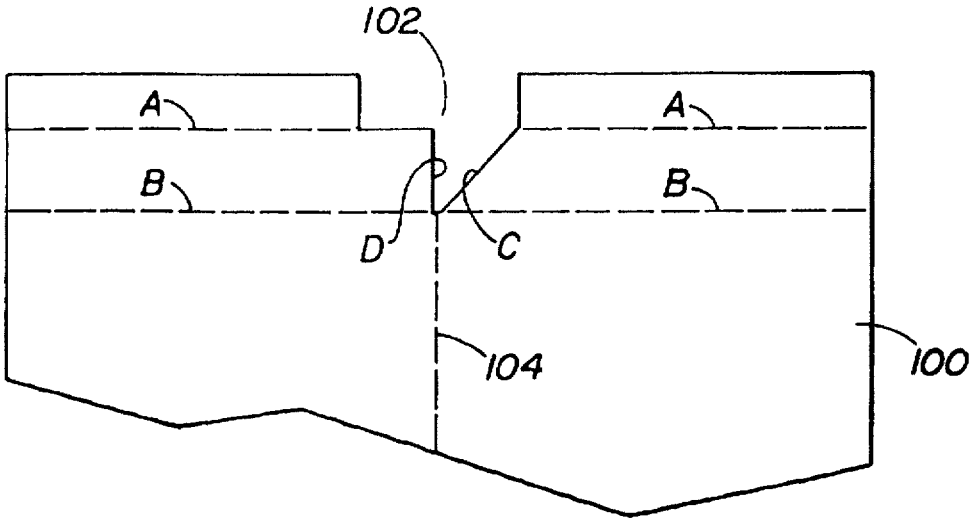
FIG. 8A is a top plan view of sheet metal that is pre-cut to form a fascia member of the present invention having a right angle along its longitudinal direction.
Figure 8B:
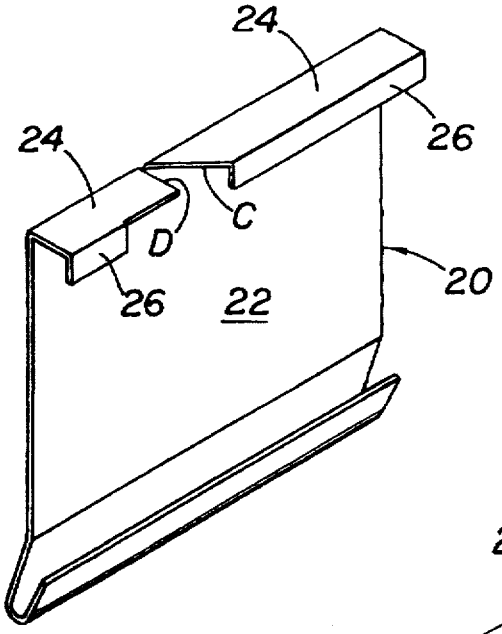
FIG. 8B is a perspective view of a fascia member formed from the sheet metal of FIG. 8A.
Figure 8C:
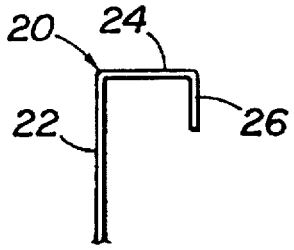
FIG. 8C is a side elevational view of the upper portion of the fascia member of FIG. 8B.
Figure 8D:
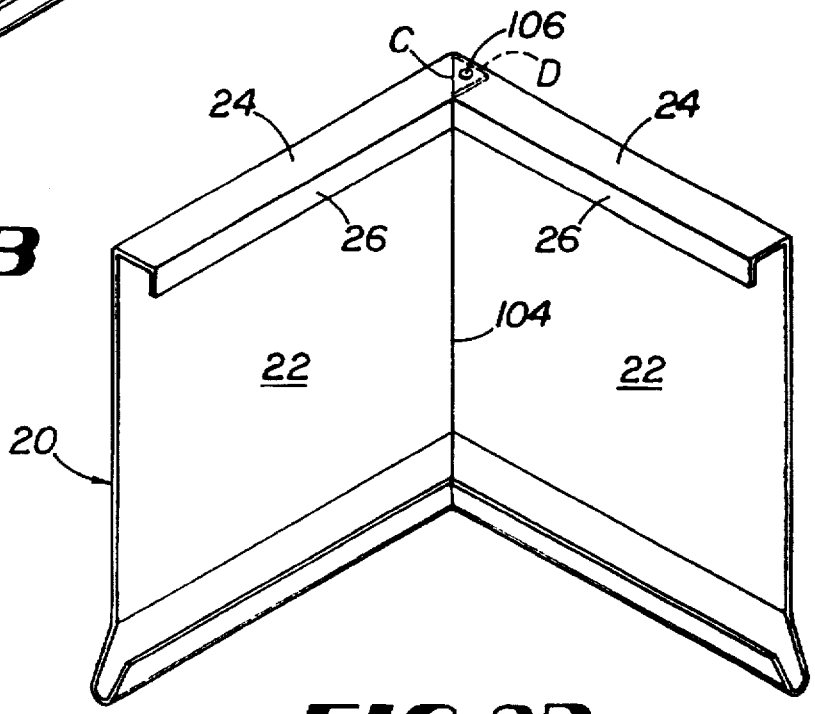
FIG. 8D is an elevated front view of the fascia member of FIG. 8B that has been folded to form a right angle.

Similarly, the fascia 10 of the present invention is easy to bend at an angle, such as a right angle. FIGS. 7A–7D and 8A–8D illustrate this. FIG. 7A shows sheet metal 100 with parallel, longitudinal fold lines A and B that is to be formed into a fascia member 22. The sheet metal 100 has a portion 102 cut therefrom at the point the fascia wall 22 will be bent. FIG. 7B shows the fascia member 20 initially formed from the sheet metal 100, and FIG. 7C shows a side view of the fascia member 20. FIG. 7D illustrates the fascia member 20 of FIG. 7B that has been bent into a right angle. The fascia member 20 has been folded along an axis 104 that is perpendicular to the longitudinal axis of the fascia member 20 and intersects portion 102 of sheet metal 100 that has been removed to form opposed edges C and D. The removed portion 102 allows the fascia member 20 to be easily folded without creating stresses. FIG. 7D shows edges C and D after the fascia member has been folded. An optional fastener 106 can be disposed through the overlapping head components 24 to ensure the fascia member 20 remains at the desired angle.

FIGS. 8A–8D show the same advantageous method of forming a corner. The difference is that the portion 102 cut form the sheet metal 100 is different. It is important to note that other patterns can be used and different portions 102 removed to allow bending the fascia member 20 to the desired angle. For example, a smaller portion 102 can be removed from the sheet metal 100 to facilitate bending the fascia member 20 to a more obtuse angle. The opposite is true for a more acute angle.

The prior art fascia member, in contrast, requires the corners to be cut to the desired angle and welded on the equivalent of the head component and fascia wall. This mitering process is more difficult and expensive than for the present invention. Although the fascia 10 of the present invention can also be cornered by mitering, there are easier, less expensive ways to make the corners. One method is pre-cutting the sheet metal, as discussed above and shown in FIGS. 7A–7D and 8A–8D. Another method is notching the head component 24 in the linearly formed fascia member 20 (not shown) and then bending it to the desired angle. The adjoining head components 24 can be welded, connected with a fastener 106, attached using another means, or not permanently attached to each other. Importantly, the fascia walls 22 do not have to be welded to each other—unlike the prior art in which the cut surfaces must be welded. Thus, the present invention has distinct advantages over the prior art fascia in bending or making a corner in the fascia member 20.

Although the present invention has been described with reference to specific details of certain embodiments thereof, it is not intended that such details should be regarded as limitations upon the scope of the invention except as and to the extent that they are included in the accompanying claims.

What is claimed is:

1. A fascia comprising:

a. a fascia member having i. an elongated fascia wall having an upper end, an opposite lower end, and an interior surface directed toward an edge of a roof deck, and ii. a head component projecting inwardly above the roof deck having a first end attached to the upper end of the fascia wall and an opposite second end;

b. a cant member having i. a first panel having a top end, at least a portion of the first panel being disposed intermediate the interior surface of the fascia wall and the edge of the roof deck, and ii. a second panel having an upper end attached to the top end of the first panel forming an acute angle therebetween, an opposite lower end detachably secured to a top surface of the roof deck, and an outer face for receiving a roofing material thereon;

c. a flashing member having i. a first segment having a first end and an opposite second end, ii. a second segment having a top end attached to the first end of the first segment and an opposite bottom end for engaging a portion of the roofing material disposed on the outer face of the second panel of the cant member, iii. an arcuate segment having a lower end connected to the second end of the first segment and an upper end, wherein at least a portion of the arcuate segment is adjacent the interior surface of the fascia wall, and iv. an upwardly-extending leg having one end attached to the upper end of the arcuate segment and an opposite free end disposed adjacent the head component of the fascia member;

d. at least one clip having i. an elongated body portion, ii. means on the body portion for engaging the fascia member, and iii. a first protrusion extending from the body portion towards the interior surface of the fascia wall and having an upper surface that detachably engages the upper end of the arcuate segment of the flashing member; and e. means disposed on the clip for adjusting the clip relative to the flashing member, wherein adjustably positioning the clip away from the first segment of the flashing member positions the free end of the upwardly-extending leg of the flashing member toward the head component of the fascia member and presses the bottom end of the second segment of the flashing member against a portion of the roofing material disposed on the second panel of the cant member.

2. The fascia of claim 1, wherein the fascia comprises at least two clips, and wherein each clip is longitudinally separated from each adjacent clip by a predetermined distance.

3. The fascia of claim 1 comprising a plurality of juxtaposed longitudinally extending fascia members along the edge of the roof deck, the fascia members further comprising a splice member disposed adjacent an interface of two abutting fascia members, the splice member consisting of:

a. a vertical segment disposed intermediate the interior surface of the fascia wall and the first panel of the cant member and having a top end, and b. an inwardly projecting segment disposed adjacent the head component of the fascia member and having a first end attached to the top end of the vertical plate and a second end adjacent the second end of the head component.

4. The fascia of claim 1, wherein the body portion of the clip has a first side and a second side which define a slot therebetween, wherein the fascia member further comprises a finger having a top end depending from the second end of the head component and an opposite bottom end, and wherein the engaging means of the clip comprises the slot defined by the body portion, the slot being of a size to slidably and detachably receive the finger of the fascia member therein.

5. The fascia of claim 4, wherein the clip further comprises a second protrusion extending from the second side of the body portion and being oppositely directed from the first protrusion, wherein the adjusting means comprises an opening through the second protrusion of the clip and a screw received therethrough, the screw having a bottom end, and wherein the screw is selectively adjusted relative to the opening in the second protrusion so that the bottom end of the screw engages the first segment of the flashing member such that further downwardly movement of the screw causes the bottom end of the second segment of the flashing member to press against the roofing material disposed on the second panel of the cant member.

6. The fascia of claim 5, wherein the clip further comprises a horizonal member fixedly attached to the second side of the body portion of the clip, wherein the horizonal member is disposed adjacent the head component of the fascia member when installing the clip, whereby the horizonal member facilitates disposing the screw through the opening in the second protrusion of the clip.

7. The fascia of claim 1, wherein the body portion of the clip has a first side and a second side, the clip further comprising a second protrusion extending from the second side of the body portion and being oppositely directed from the first protrusion, wherein the adjusting means comprises an opening through the second protrusion of the clip and a screw received therethrough, the screw having a bottom end, and wherein the screw is selectively adjusted relative to the opening in the second protrusion so that the bottom end of the screw engages the first segment of the flashing member such that further downwardly movement of the screw causes the bottom end of the second segment of the flashing member to press against the roofing material disposed on the second panel of the cant member.

8. A fascia disposed adjacent a roof deck having a top surface and an edge, the fascia comprising:

a. a fascia member having i. an elongated fascia wall having an upper end, an opposite lower end, and an interior surface directed toward the edge of the roof deck, and ii. a head component projecting inwardly above the roof deck having a first end attached to the upper end of the fascia wall and an opposite second end;

b. a cant member having i. a first panel having a top end, at least a portion of the first panel being disposed intermediate the interior surface of the fascia wall and the edge of the roof deck, and ii. a second panel having an upper end attached to the top end of the first panel forming an acute angle therebetween, an opposite lower end detachably secured to the top surface of the roof deck, and an outer face for receiving a roofing material thereon;

c. a flashing member having i. a first segment having a first end and an opposite second end, ii. a second segment having a top end attached to the first end of the first segment and an opposite bottom end for engaging a portion of the roofing material disposed on the outer face of the second panel of the cant member, iii. an arcuate segment having a lower end connected to the second end of the first segment and an upper end, wherein at least a portion of the arcuate segment is adjacent the interior surface of the fascia wall, and iv. an upwardly-extending leg having one end attached to the upper end of the arcuate segment and an opposite free end disposed adjacent the head component of the fascia member;

d. at least one clip having i. an elongated body portion, ii. means on the body portion for engaging the fascia member, and iii. a first protrusion extending from the body portion towards the interior surface of the fascia wall and having an upper surface that detachably engages the upper end of the arcuate segment of the flashing member; and e. means disposed on the clip for adjusting the clip relative to the flashing member, wherein adjustably positioning the clip away from the first segment of the flashing member positions the free end of the upwardly-extending leg of the flashing member toward the head component of the fascia member and presses the bottom end of the second segment of the flashing member against a portion of the roofing material disposed on the second panel of the cant member.

* * * * *